US011124969B2

(12) United States Patent
Rider

(10) Patent No.: US 11,124,969 B2
(45) Date of Patent: Sep. 21, 2021

(54) ROOF SEAMING APPARATUS WITH MULTIPLE TOOLING STATIONS IN A MODULAR FORMAT

(71) Applicant: Terry L. Rider, Corinth, MS (US)

(72) Inventor: Terry L. Rider, Corinth, MS (US)

(73) Assignee: RIDER RENTS SIX, LLC, Corinth, MS (US)

( * ) Notice: Subject to any disclaimer, the term of this patent is extended or adjusted under 35 U.S.C. 154(b) by 115 days.

(21) Appl. No.: 16/249,918

(22) Filed: Jan. 17, 2019

(65) Prior Publication Data

US 2020/0232221 A1 Jul. 23, 2020

(51) Int. Cl.

| | |
|---|---|
| ***E04D 3/367*** | (2006.01) |
| ***B21D 39/02*** | (2006.01) |
| ***E04D 15/04*** | (2006.01) |
| *E04D 3/16* | (2006.01) |

(52) U.S. Cl.

CPC ..... *E04D 3/364* (2013.01); *B21D 39/023* (2013.01); *E04D 15/04* (2013.01); *E04D 3/16* (2013.01)

(58) Field of Classification Search

CPC .... B21D 39/02; B21D 39/021; B21D 39/023; B21D 19/04; B21D 19/043; B21D 19/046; B21D 19/06; E04D 3/364; E04D 15/04; E04D 3/16

USPC .... 29/505, 514, 521; 72/210, 214, 216, 220; 52/749.12

See application file for complete search history.

(56) References Cited

U.S. PATENT DOCUMENTS

| | | | | |
|---|---|---|---|---|
| 3,138,397 | A * | 6/1964 | Griffiths | B25B 21/002 81/473 |
| 4,064,819 | A * | 12/1977 | Fox | B21D 39/02 29/243.57 |
| 4,372,022 | A * | 2/1983 | Puckett | B21D 39/02 29/243.58 |
| 8,312,605 | B1 * | 11/2012 | Rider | E04D 15/04 29/243.5 |
| 2010/0077697 | A1 * | 4/2010 | Rider | E04D 15/04 52/748.1 |
| 2018/0369966 | A1 * | 12/2018 | Hansen | B23K 26/348 |

* cited by examiner

*Primary Examiner* — William V Gilbert
(74) *Attorney, Agent, or Firm* — William S. Parks

(57) ABSTRACT

An apparatus for seaming roof assemblies having a modular provision of tooling stations is disclosed herein. Such an apparatus includes multiple tooling stations that may be added or removed on demand in order to facilitate different degrees of seaming engagements as needed. Such a device utilizes horizontal rollers to provide seaming of overlapping roof panel ends to reduce the potential for separation thereof after building erection has been undertaken, further impeding water egress therethrough and wind updraft damage, at least, as well. The modular device thus provides a manner of selecting specific numbers of horizontal rollers for seaming contact with metal roof panels, thereby allowing for different types of panels and end structures thereof, as well as reduce the propensity for jamming of such multiple rollers during utilization. The method of utilization of such a modular device is encompassed herein as well.

2 Claims, 30 Drawing Sheets

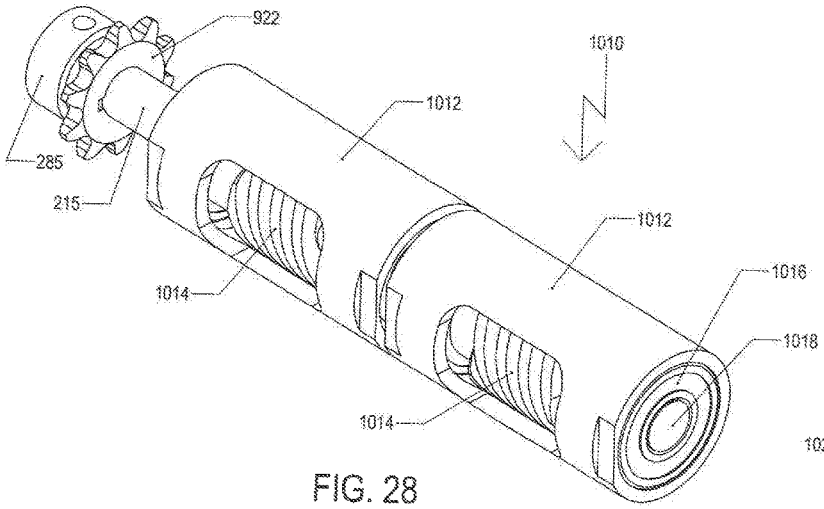
FIG. 28
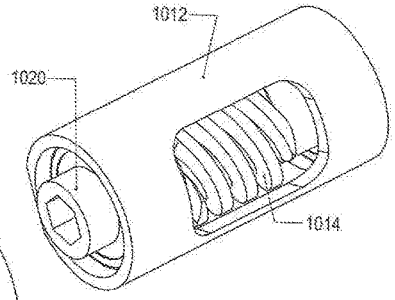
FIG. 28A
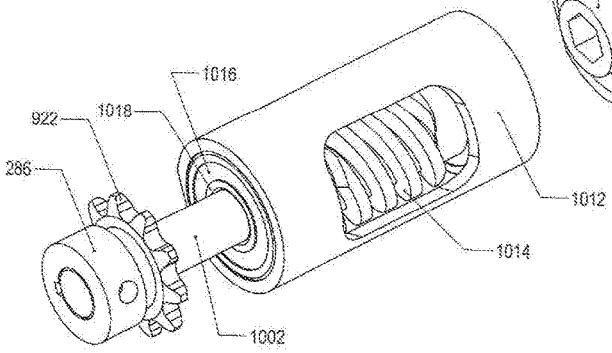

ROOF SEAMING APPARATUS WITH MULTIPLE TOOLING STATIONS IN A MODULAR FORMAT

FIELD OF THE INVENTION

A device for seaming roof assemblies having a modular provision of tooling stations is disclosed herein. Such a device includes multiple tooling stations that may be added or removed on demand in order to facilitate different degrees of seaming engagements as needed. Such a device utilizes horizontal rollers to provide seaming of overlapping roof panel ends to reduce the potential for separation thereof after building erection has been undertaken, further impeding water egress therethrough and wind updraft damage, at least, as well. The modular device thus provides a manner of selecting specific numbers of horizontal rollers for seaming contact with metal roof panels, thereby allowing for different types of panels and end structures thereof, as well as reduce the propensity for jamming of such multiple rollers during utilization. The method of utilization of such a modular device is encompassed herein as well.

BACKGROUND OF THE INVENTION

Standing seam roof assemblies have been utilized for simpler manufacturing, particularly in order to reduce complexity in erecting buildings. In such assemblies, numerous panels are supplied with differing end portions, each having what is termed a female portion and a smaller male portion. In such a manner, the panels are laid one next to the other and secured through seaming the male and female portions of adjacent panels together. Such roof assemblies are designed to provide excellent watertight seals as well as effective wind resistance to ensure leak-proof structures as well as high stability against updrafts. Additionally, the seams include panel portions that are allowed to flex to compensate for temperature variations so the roof itself will not disintegrate upon contraction or protraction. For simplification of the overall assembly system, the seamed panels are attached to the building structure via brackets or like components, at a limited number of points in each connected panel. Thus, it is very important to provide excellent seal strengths upon seaming of such individual roof assembly panels together in order ensure the roof assembly does not destabilize at the seam attachment points. As well, the seaming procedure is generally accomplished through the utilization of a motorized seaming apparatus that moves along the length of overlapping edges of adjacent panels. Such an apparatus thus when engaged for seaming at the panel edges relies upon the proper alignment of the edges with the apparatus itself to properly function in a seaming capacity as well as smoothly move along the panel lengths themselves. Any imperfections in the shape or position of the panel edges may skew not only the finished seam, but also potentially cause the motorized apparatus to jam or otherwise fail during utilization itself.

The panels themselves are made generally from metal materials that exhibit excellent strength characteristics, low propensity for rusting, and, of great importance, suitable flexibility for seaming to be accomplished. The seam between the two panels provides not only waterproof seals between panels, but also the ability to hold the two panels together effectively to prevent or at least substantially reduce any slippage between them, as alluded to above. Any appreciable reduction in the dimensional stability of the roof assembly itself would result in roof failure from a leakage perspective, at least. Again, however, it is very difficult to actually provide uniform shapes and/or configurations of such panels, particularly in terms of the angles of the edge portions that must overlap between male and female portions of adjacent panels. At the installation site, it has been such a problem that a user must do his or her best to maneuver the edge portions of panels to meet the necessary overlapping positions for proper seaming and overall installation to occur. This is of particular concern when the panels themselves do not exhibit structural uniformity, specifically in terms of the angles at which the overlapping female and male portions are disposed. Imperfections in the roof panels require intensive modification through on-site estimates as to the proper alignment settings of the seaming rollers within the seaming apparatus itself. This deficiency can lead to aesthetically displeasing roof assembly results, not to mention the potential for seam failures if the estimations are incorrect. It is thus of high desirability to provide a manner of utilizing virtually any set of roofing panels together and seam them to the degree needed for proper protections, as noted above.

To attempt to compensate for such problems, past developments have included seaming apparatuses including stationary damping posts that provide some semblance of uniform starting positions for the engagement of seaming rollers. Unfortunately, such stationary damping posts do not always align with the seaming rollers themselves; any misalignment between such different seaming apparatus components would result in the same potential skew problems such developments were intended to remedy. Likewise, some seaming methods have included adjustable damping mechanisms to provide differing angles for the panel edges prior to seaming roller engagement. However, these previous adjustable mechanisms are based on swing levers and only provide angular deflections in the panel edges; no uniformity with the desired initial positioning of the seaming rollers for proper straight seams to form are possible with such swing levers. Furthermore, these were always independent of the adjustments provided for the seam rollers themselves. It was thus incumbent upon the installer to properly estimate the degree of edge deflection necessary by the swing lever device to meet the requirements of the seam rollers. The lack of definitive angle uniformity has thus created much of the same problems as noted above as well.

Additionally, the gauge and type of roofing panels, as well as the male and female ends thereof, may differ from one installation job to another, thus necessitating a way to properly deliver the appropriate torque and pressure throughout the seams without damaging or marring the same or, to the contrary, failing to apply the needed forces for a single-pass seaming application. As such, the ability of standard seaming devices to achieve a uniform consistency for different roof panel types has proven difficult, as well. The ability to accord a pre-selected force application through a series of pressure rollers over the subject seam has been limited to engagement and disengagement of such components within standard seaming devices. There has been nothing accorded this industry, however, that allows for complete removal or extra addition of roller components for a more dialed-in overall seaming operation. Such a system would allow for greater flexibility for the user, both in terms of determining the appropriate seaming devices utilized from a pressure perspective as well as providing more effective judgement as to the device itself (and thus the weight and structure thereof as brought onto and utilized on a roof installation). Such versatility would permit a safer, more reliable, and more effective seaming operation. Unfortunately, improvements in such previous attempts at providing greater reliability in elevated roof assembly seaming procedures have been so limited; something more has been needed within this industry to allow for greater efficiency in roof assembly with little fear of seaming apparatus failure, not to mention failure of such completed roof seams as well. To date, there has been nothing that permits greater reliability than these deficient developments.

Advantages and Summary of the Invention

One distinct advantage of the inventive apparatus and method is to provide extremely strong seals at the female/male portion interface of an elevated seam roof assembly at selected levels of seaming pressure with an on-demand pressure-level device with modular components, rather than a single structure device. Additionally, a distinct advantage of the inventive seaming apparatus is the ability to allow for better capture and control of the panels to be seamed by simply adding as many tooling stations as necessary to perform the task. Another advantage is that each station can be fitted with virtually any shape of forming roller necessary to adapt to not only panel deformities, but changes in the desired finished seam. Yet another advantage of such an inventive apparatus is the reliability provided to the user that the motorized apparatus will not jam or otherwise fail during installation due to improperly aligned overlapping edges.

Accordingly, this invention encompasses a modular roof panel seaming apparatus including a plurality of individual, connectable, devices each comprising a plurality of rollers attached in rotatable relation to a base aligned for engagement with female and male roof panel portions of separate but adjacent panels at the same time and at least one of said rollers, wherein said female and male roof panel portions have overlapping edges when placed one over the other in parallel fashion, wherein said rollers create a seam between said female and male roof panel portions when activated along the length of said roof panel portions; wherein said rollers are interchangeable between different sizes and pressure application levels; and wherein each of said individual, connectable devices is operated by a single motor when such individual, connectable devices are connected together in any number. Also encompassed within this invention is a method of creating a seam between two roof panels including a female edge portion and a male edge portion present in overlapping relation to one another, said method comprising:

a) providing a first roof panel having an elevated female end portion and an opposite elevated male portion, said female portion having an edge, and said male portion having an edge substantially parallel to said female portion edge, providing a second roof panel substantially identical to and having the same type of female and male end portions as said first roof panel, wherein said first and second roof panels are placed in overlapping, parallel relation to each other, wherein said female end portion of said first roof panel is present over said male end portion of said second roof panel;

b) placing a modular seaming apparatus including at least one of a plurality of individual, connectable devices having a plurality of rollers attached in rotatable relation to axles aligned for engagement with female and male roof panel portions of separate but adjacent panels at the same time over an initial length of the overlapping edges of said female and said male end portions of said first and second roof panels;

c) engaging said rollers within said at least one of a plurality of individual, connectable devices to position and apply force to the panels in proper alignment for seaming of said overlapping end portions;

d) activating said apparatus thereby permitting automatic movement of the apparatus over the overlapping end portions of said first and second roof panels in a direction parallel to the direction in which said first and second roof panels are placed on said roof; and e) removing said apparatus upon completion of movement over said overlapping first and second roof panel end portions. In this manner, an entire roof assembly including such particular panels having elevated end portions for seaming may be reliably attached to one another in series. The method utilizing at least two of said plurality of individual, connectable devices connected to convey applied pressure through said plurality of rollers is also encompassed herein, with the number of individual devices connected for such a purpose up to five (and thus may be separately three or four devices connected in such a manner for such a purpose). The resultant roof provided by such seamed joints thus exhibits excellent strength due to the uniform seams present therein.

Thus, the present disclosure relates to an apparatus for the seaming of roof assemblies for a building structure, wherein the apparatus consists of multiple tooling stations (a modular unit, in other words) that may be added or removed as needed to allow for engagement of horizontal rollers to perform the seaming procedure. Such an apparatus thus permits the utilization of virtually any type of metal paneling to create the desired roof assembly, with the capability of providing a secure, reliable seal within the seam to increase the waterproofing and uplift protection potential thereof as well as to best ensure the seaming apparatus does not jam or otherwise fail during the seaming process itself. The versatility permitted with such an apparatus allows for utilization of imperfectly shaped and/or configured panels for elevated seamed roof assembly purposes. With this design, it will be possible to add multiple stations, as much as necessary, by simply coupling (connecting) the additional units in appropriate series. Each unit is coupled to the drive shaft and is therefore powered by the base machine power source (e.g., the system is operated through a single motor and the other component devices do not run individually, but through and upon connection with at least the motor base component device).

As alluded to above, safety is of extreme concern with any occupation that requires intensive labor at elevated heights off of the ground. In the roofing industry, it is evident that an edifice is first erected through providing the building skeleton (girders, beams, etc.) as well as potentially, particularly for commercial buildings, brick, stone, or other like materials for outside walls. The roof thus must be constructed on site, and atop the building skeleton. Multiple types of roofing materials could be utilized for such a purpose; the types at which the inventive apparatus and method are directed are those that involve relatively long, but relatively narrow, panels that, as discussed throughout, are attached through seams to produce a single roof assembly. Such panels include the elevated female and male members as noted above for such seaming purposes; in addition, though, the seams provide excellent characteristics in relation to thermal expansion and contraction possibilities, in addition to the low slippage and watertight properties highly desired. The stronger the seam, however, the better the overall protection to the roof assembly from damaging high winds.

Such panels are generally made from different gauge metals (such as steel, stainless steel, aluminum, and the like), and are selected in terms of their load properties, among other reasons. The flexibility of the panels is important in terms of the above-discussed characteristics for thermal expansion and wind resistance; however, the load itself also contributes to the potential difficulties with seaming of the elevated end portions together as well. This potential issue can be compensated for with a proper motorized seaming apparatus (such as a motor attached to a movable base) exhibiting the proper torque to maneuver the female and male end portions as needed for proper seaming to be accomplished. Generally, aluminum exhibits the lowest gauge and thus is easier on the motor of the seaming apparatus; however, such a material also exhibits the least reliability in terms of roof assembly panels as well, due to its malleability level. Steel and stainless steel (and other like higher gauge metals) are thus preferred. Additionally, to protect from environmental and water damage, the metal surface is usually accorded a proper coating (anti-rust paint, for example).

Furthermore, the adjacently disposed roof panels are supported by an underlying support structure to which the panels may also be attached through clips or other like objects. Backer and/or cinch plates may be added to the overlapped edge seams in the roof assembly as well, if desired, to increase the overall strength of the roof.

The features, benefits and advantages of the present invention will become apparent from the following detailed description when read in conjunction with the drawings and appended claims.

Thus, through this unique apparatus, a properly crimped and hooked safe and secure roof assembly may be constructed in a relatively safe manner while allowing unparalleled flexibility regarding the machines capability to adapt to multiple panel types, in terms of needed pressure application levels, seam heights, and installation issues that may arise.

BRIEF DESCRIPTION OF THE DRAWINGS

FIG. 28 is a side perspective view of a gear tube including a wormgear component.

FIG. 28A is an exploded side perspective view of the gear tube and wormgear of FIG. 28.

DETAILED DESCRIPTION OF THE DRAWINGS AND PREFERRED EMBODIMENTS

The following descriptions and examples are merely representations of potential embodiments of the present disclosure. The scope of such a disclosure and the breadth thereof in terms of claims following below would be well understood by the ordinarily skilled artisan within this area.

Figure 1:
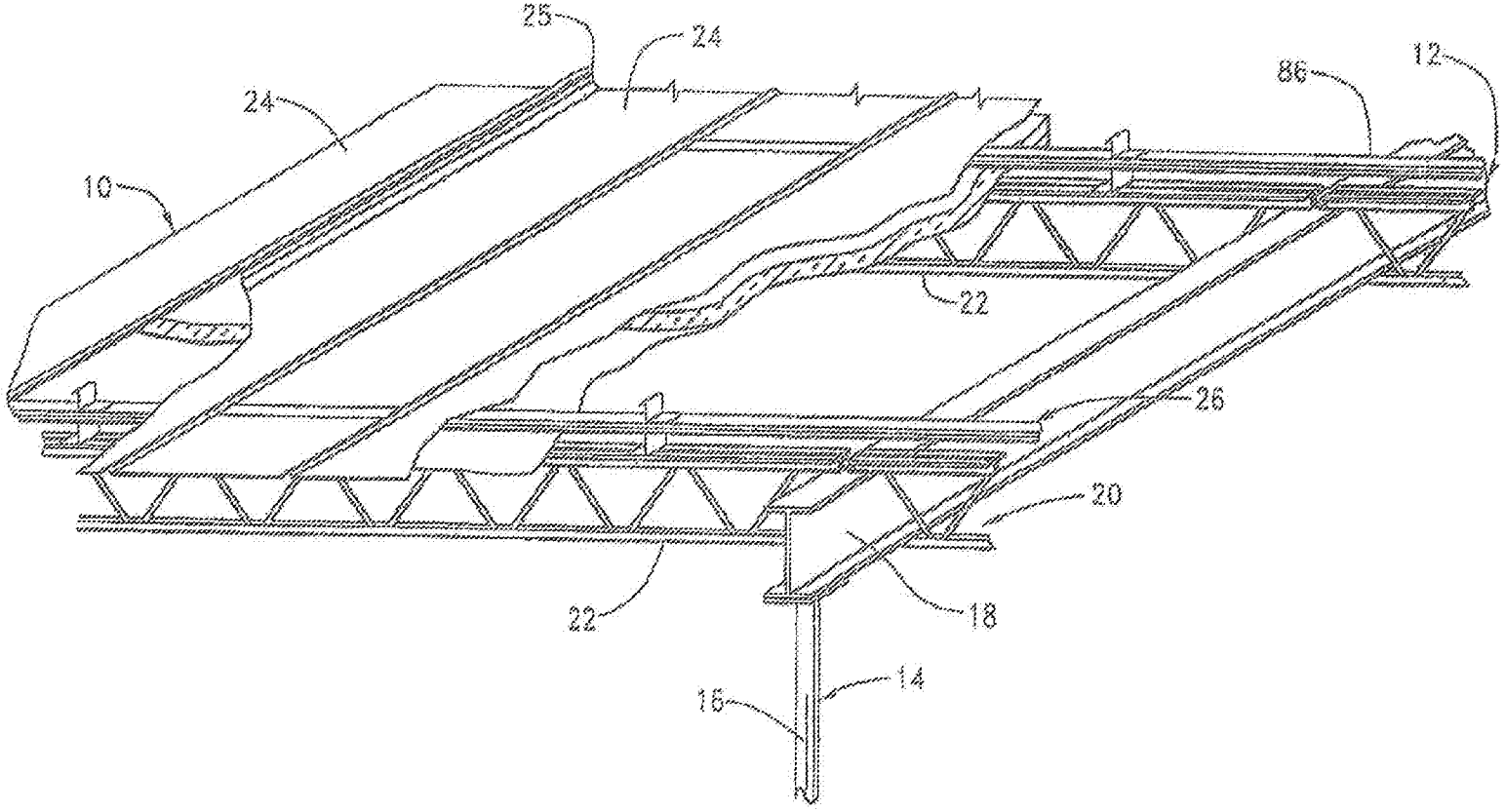
FIG. 1 is an isometric, partial cut-away view of a portion of a roof system utilizing a standing seam roof assembly.

Referring to FIG. 1, there is depicted a pre-engineered building roof 10 supported by a pre-engineered building structure 12. Such a pre-engineered structure 12 comprises a primary structural system 14 including a number of upwardly extending column members 16 [to be connected to a base foundation (not illustrated)]. Also, the primary structural system 14 has a plurality of beams 18 which are supported by the column members 16.

Also included is a secondary structural system 20 including a number of open web beams 22 attached to and supported horizontally by the primary beams 18. Alternative structures may be employed in place of these web beams 22, if desired. A plurality of roof panels 24 are supported over the secondary structural assembly 20 by a plurality of panel support assemblies 26 and are attached to the upper flanges of the web beams 22. The roof panels 24, only portions of which are shown, are depicted as being standing seam panels with interlocking standing seams 25 connected by clip portions of the panel support assemblies 26. Alternatives to such clips may be practiced as well and other clips may be incorporated within the panels to hold them in place with the building skeletal portions noted above.

Figure 2:
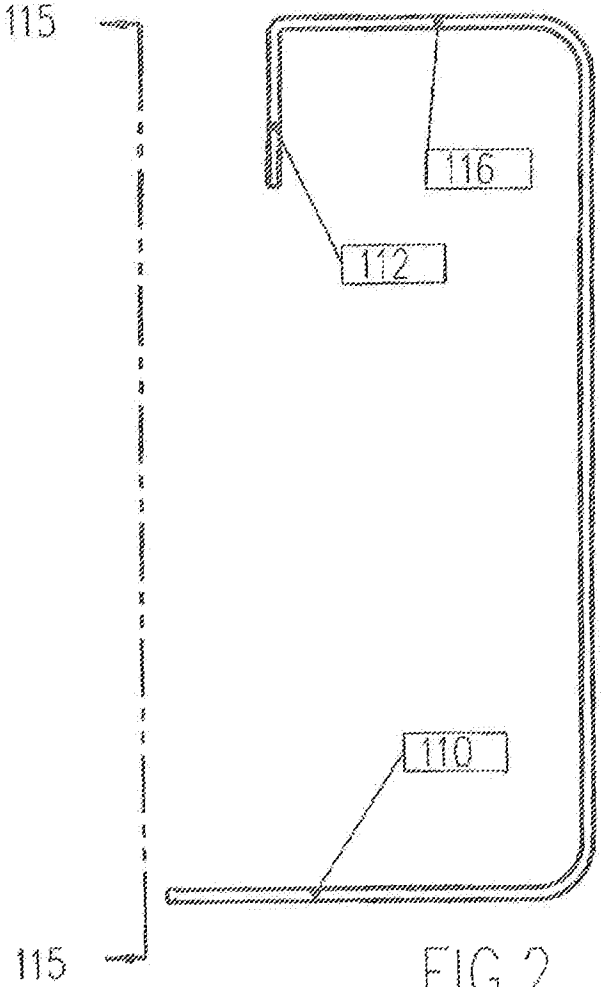
FIG. 2 is a cross-sectional view of the male end portion of a roof panel.

FIG. 2 depicts the male end portion 115 of an end panel (partially shown as 110). The end portion 115 includes an elevated end component 114 that bends substantially 90 degrees from the plane of the panel 110 that leads into a top end component 116 that bends substantially 90 degrees from the plane of the elevated end component 114 back toward the panel 110 and is substantially parallel to the panel itself 110. Another substantially 90 degree bend in the material then leads to an edge portion 112 being the edge of the entire panel 110 on the male portion side 115. This edge portion 112 is parallel with the elevated end component 114. The top end component 116 is thus raised to a predetermined height through the length of the elevated end component 114. The edge portion 112 is extended a predetermined length from the top end portion 116 as well.

Figure 3:
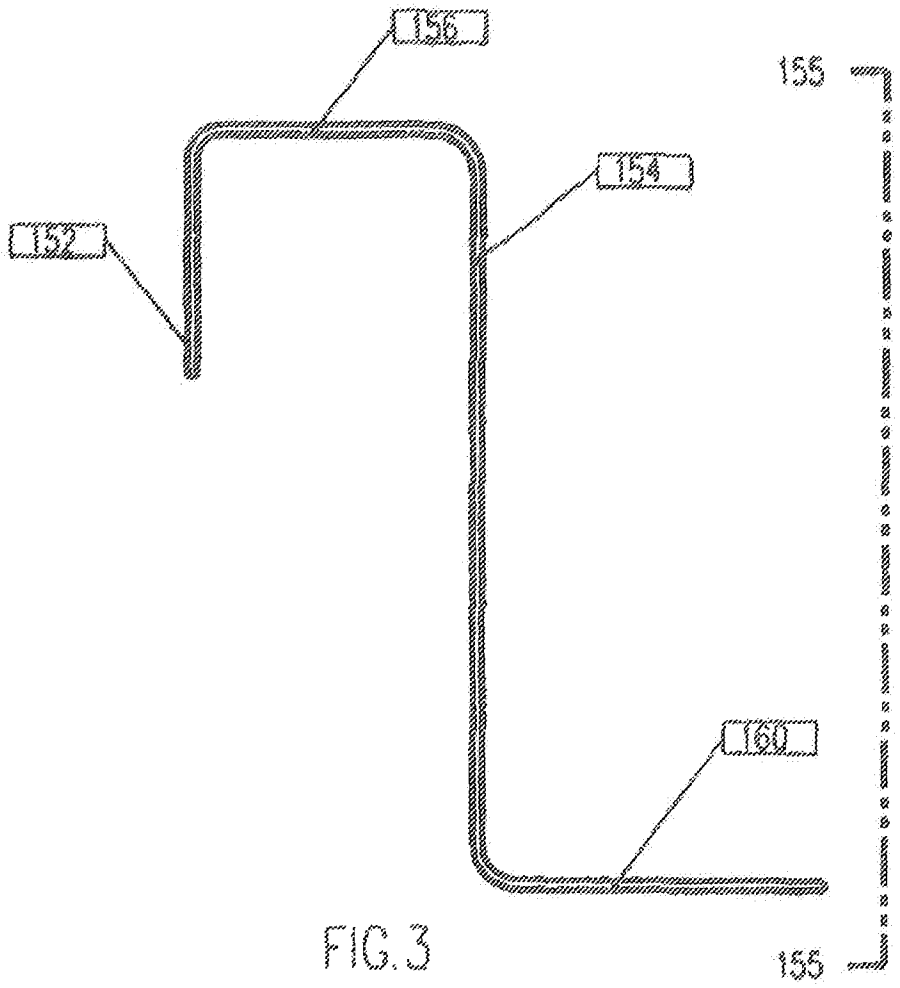
FIG. 3 is a cross-sectional view of the female portion of a roof panel.

FIG. 3 depicts a female end portion 155 of a panel (partially shown as 160) with an elevated end portion 154 that bends substantially 90 degrees from the plane of the panel 160 that leads into a top end component 156 that bends substantially 90 degrees from the plane of the elevated end component 154 and away from the panel 160 and is substantially parallel to the panel itself 160. Another substantially 90 degree bend in the material then leads to an edge portion 152 being the edge of the entire panel 160 on the female portion side 155. This edge portion 152 is parallel with the elevated end component 154. The top end component 156 is raised to a predetermined height in relation to the height of the male portion side (115 of FIG. 2) in order to permit snug engagement of the male portion side (115 of FIG. 2) under and within the female portion side 155. As well, the edge portion 152 is provided at a length longer than that of the male portion side edge portion (112 of FIG. 2) in order to accomplish this snug fit in addition to permitting effective seaming of the two portion sides (115 of FIG. 2 and 155 of FIG. 2). Each panel used in roof construction will have one male side portion and one female side portion (as alluded to in FIG. 1, above).

Figure 4:
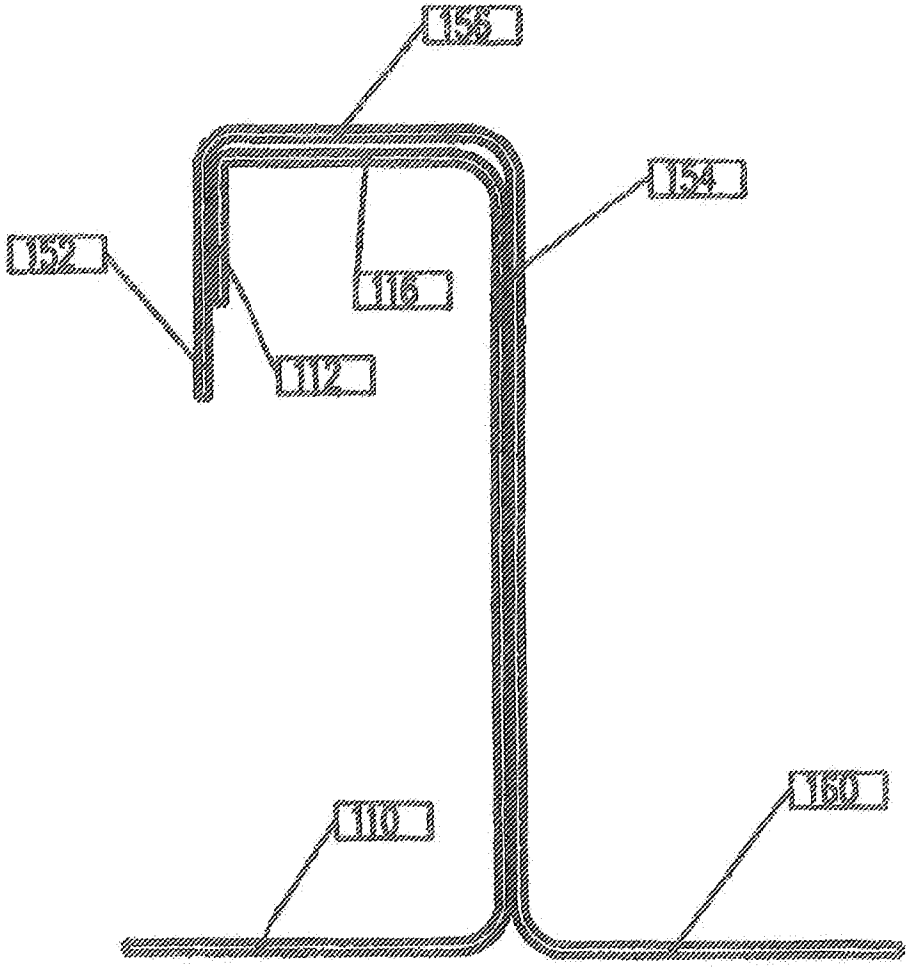
FIG. 4 is a cross-sectional view of interlocked female and male portions of two roof panels prior to seaming.
Figure 5:
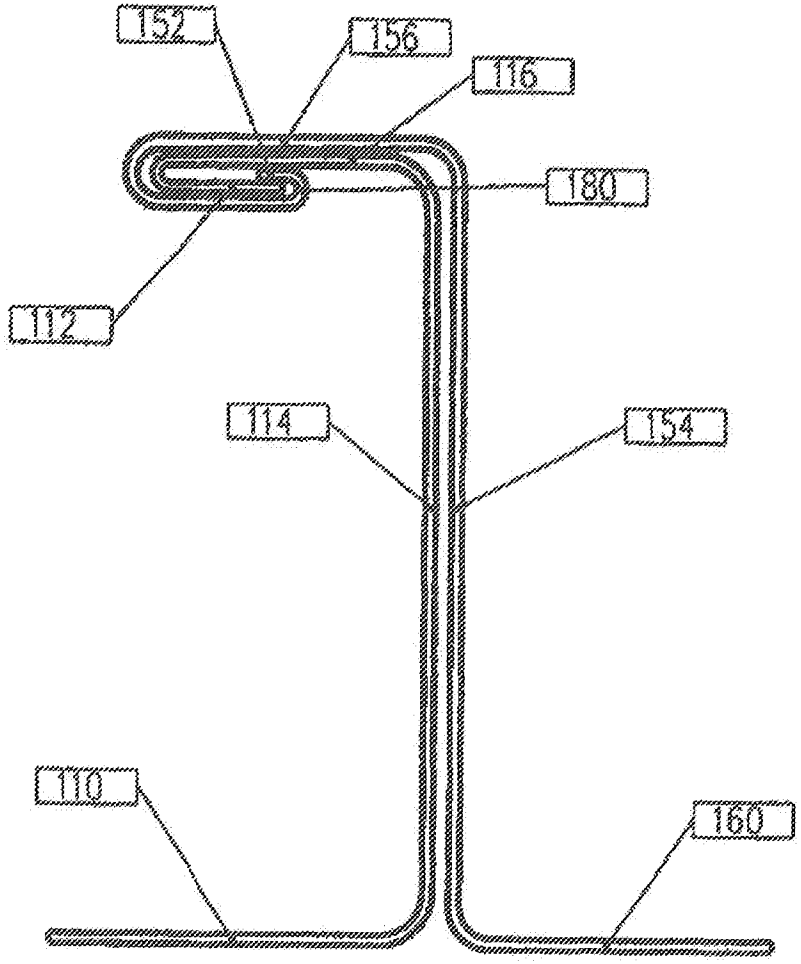
FIG. 5 is a cross-sectional view of interlocked female and male portions of two roof panels subsequent to seaming.

FIG. 4 thus shows the engagement of the two portion sides of the two panels 110, 160 through placement of the female elevated end component 154, the female top end component 155, and the female edge portion 152 over the male elevated end component 114, the male top end component 116, and the male edge portion 112. Upon seaming, as depicted in FIG. 5, through the utilization of the inventive seaming apparatus (such as 210 in FIG. 6), the two panels 110, 160 are maneuvered at their male and female edge portions 112,152 to form a strong seal with a hook 180. The elevated end portions 114, 154 and the top end portions 152, 156 remain in substantially the same shape and dimensions as prior to seaming. This resultant seamed combination of roofing panels is thus repeated in sequence with a plurality of such panels to form a roof (as shown in FIG. 1).

FIGS. 6-25 and 27 depict the modular apparatus types of the present disclosure as provided (both individually and connected in certain structures) as well as in different stages of potential utilization for seaming a target interlocked set of roofing panels (as shown in FIG. 5). The components of the apparatus may be of virtually any material of suitable strength to impart sufficient torque and resist rupture or any other like structural failure during a seaming operation. Certain parts may be of plastic construction if they are not in contact with the targeted roof panels themselves (such as handle covers, adjusting shafts, and the like) or used as wheel components. To initiate the seaming process, it may be necessary for the installer to utilize a manual crimper on the first few inches of the target overlapping panels.

Figure 6:
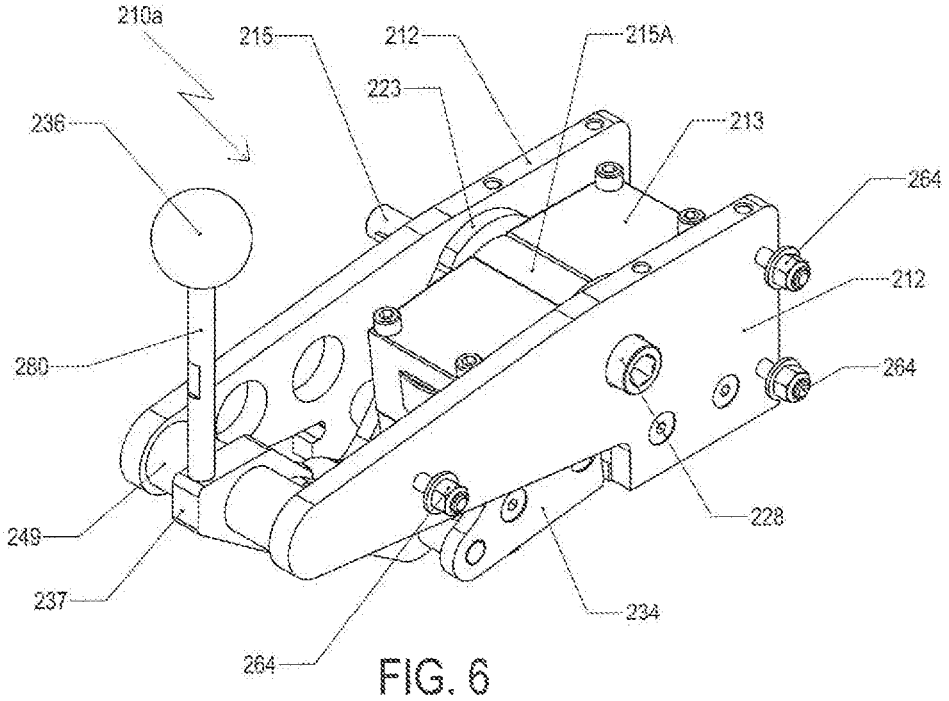
FIG. 6 is a side perspective view of one embodiment of a front station of a modular roof panel seaming apparatus.
Figure 7:
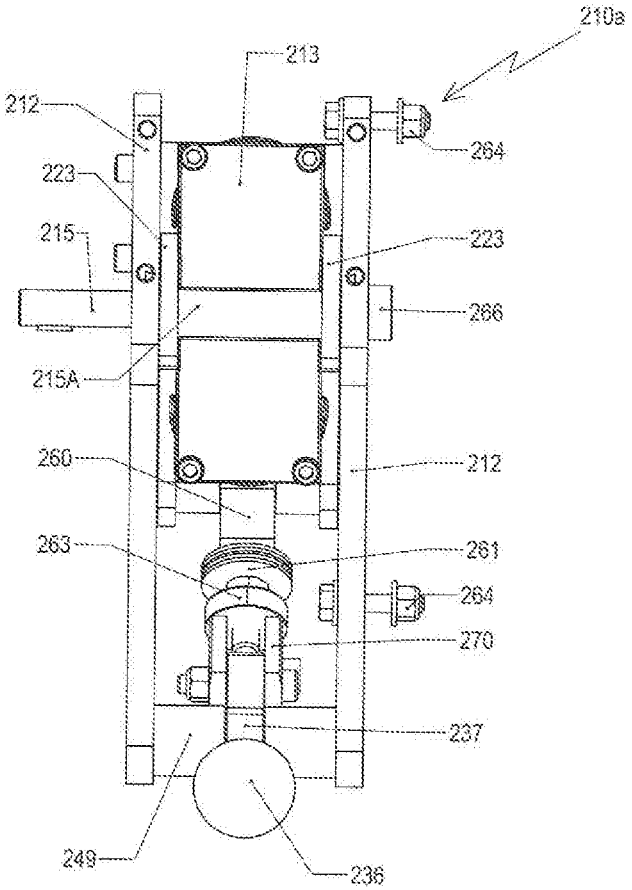
FIG. 7 is a top view of the same front station modular unit of FIG. 6.
Figure 30:
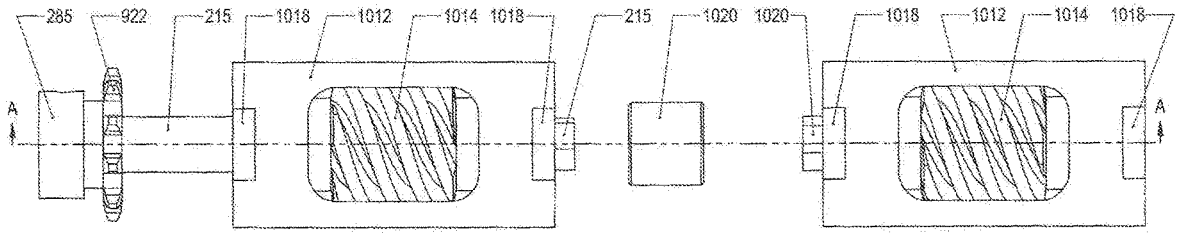
FIG. 30 is a different exploded view of FIG. 29.
Figure 30A:
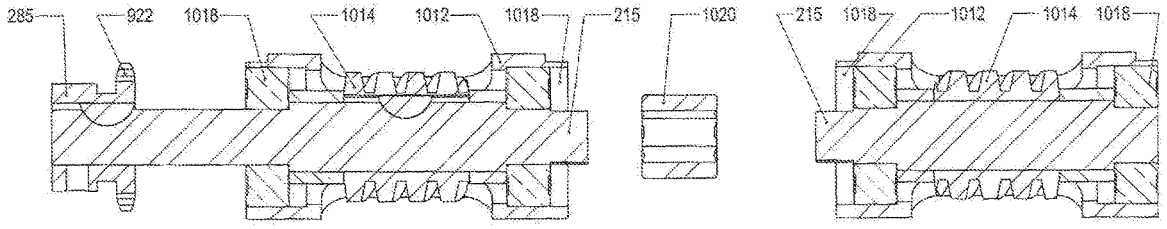
FIG. 30A is a cross-sectional view of FIG. 30 along line A-A.

As depicted, then, in FIGS. 6 and 7, there is a front station (wheel bearing) component 210*a*, including rotating transport wheels (such as 250 of FIG. 18), a base component 212 including a lowering/raising arm 280 with a knob handle 236 to control operability of the crimping mechanism 234 through a pivoting structure 270 and a control arm portion 280 (with a spacer 249 from the base 212). The arm 236 rotates through a pivot plate 237 and a pivot block 260. Between the plate 237 and block 260 are a turnbuckle adjuster 263 and a Belleville spring 261 to absorb pressure as the pivot is undertaken and during operation of the apparatus 210*a*. The front (wheel bearing) station 210*a* further includes a housing 213 covering the gears for controlling the roller mechanics (roller) 234, and also includes an extended coupler 228 leading to a gear tube 215A and a drive module 215. The gear tube 215A includes a main shaft (1012 of FIG. 30) within which a worm gear (1014 of FIG. 30) is present to drive the roller mechanics 234. The external coupler 228 is provided for insertion and connection with another station (such as the middle station 210B of FIGS. 8 and 9) for connection of a separated gear tube and worm gear for ultimate relation with the drive module 215 that connects, for instance, with a chain sprocket (922 of FIG. 18, for example) and thus a drive chain (287 of FIG. 25, for instance) to allow for simultaneous worm gear (1014 of FIG. 30) activity and operation to control the roller mechanics 234 and the swing arm 223 as well to provide sufficient torque from the roller (287 of FIG. 25, for instance) to the roof panel seam (152 of FIG. 22) (Such a coupler may be provided flush in relation to the gear tube and wormgear components or may provide an extension that allows for some distance between stations; if so, the connectors shafts 264, 364, etc., may be aligned in the same manner for such a distance). The pivot plate 237 and block 260 thus allows for movement and manipulation of the roller (287 of FIG. 22, for example) as desired, from full interface to none, on demand. The wheel bearing front station 210A further includes three shaft connectors 264 that function, in addition to the external adapter 228 to attach the station 210A with another with the simultaneous controlling of roller mechanics for all stations as connected in such a manner, thus allowing for the modular capability herein described. Such other station or stations allows for such secure connections thus permitting reliably high torque pressure applications on and over a roof panel seam of any level desired with only needing the selection of a suitable roller and connection of such other stations to the first wheel bearing station. As long as at least one other wheel bearing station (end) is provided, the apparatus can thus be applied over a subject roof panel seam for such operation. Additionally, however, it should be noted that if the user decides to utilize more than, for example, five total stations for such a purpose, such is possible and a mid-station wheel bearing component may be included. In essence, the length of the modular apparatus may be of any acceptable and suitable length with any number of wheel bearing stations present. Further connectors 264 are provided to allow greater reliability between stations, as well.

Figure 8:
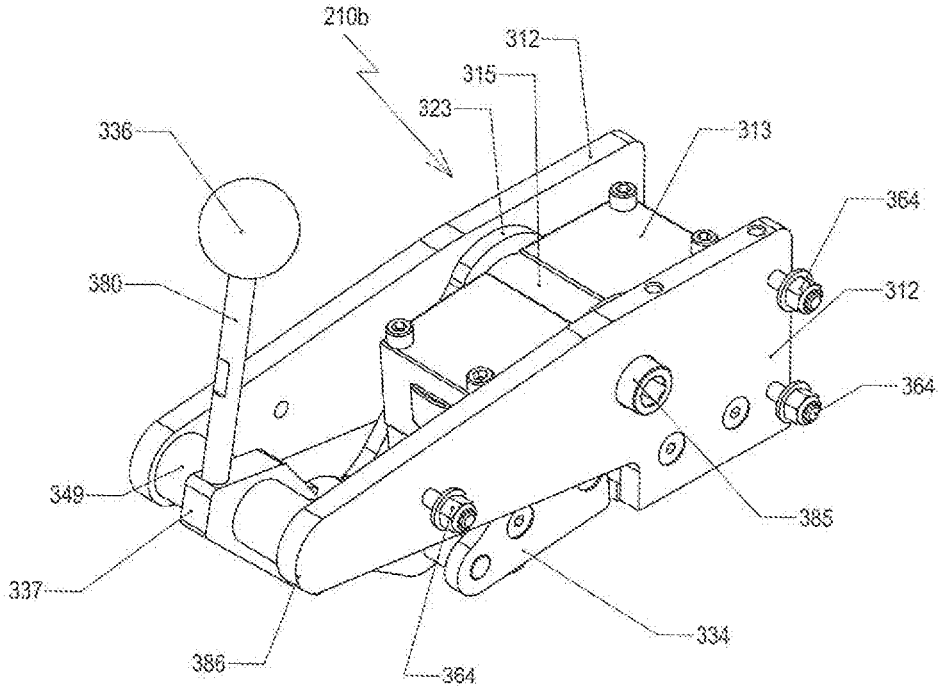
FIG. 8 is a side perspective view of one embodiment of a middle station of a modular roof panel seaming apparatus.
Figure 9:
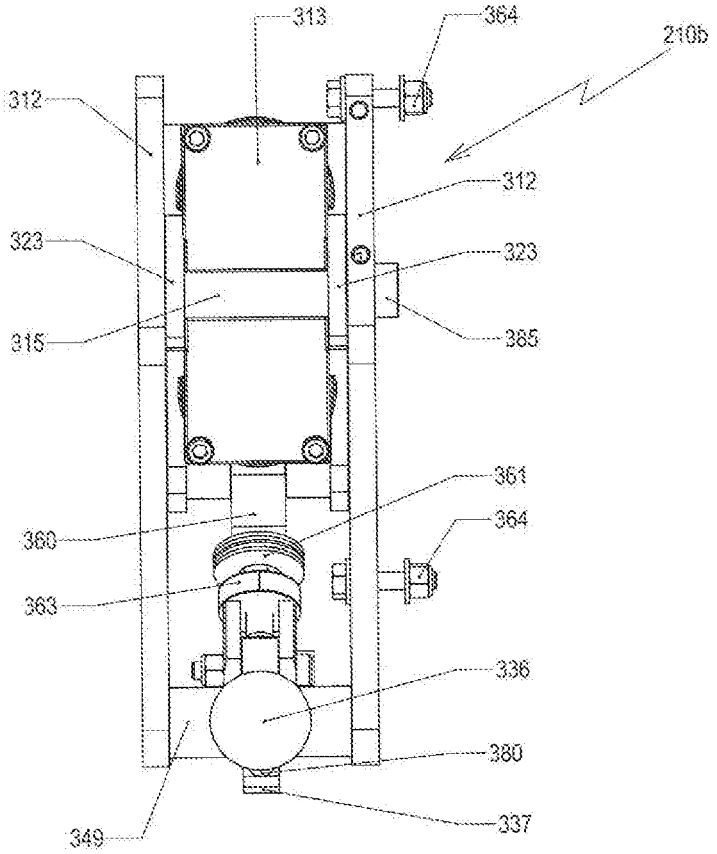
FIG. 9 is a top view of the same front station modular unit of FIG. 8.

As such, FIGS. 8 and 9 show a middle station 210*b* (as noted above) having similar structures as for the front station 210*a*, with a base component 312, a housing 313 over a roller crimping mechanism 334, a lowering/raising arm 380 with a knob handle 336 to control operability of the crimping mechanism 334 through a pivoting structure 370 and a control arm portion 380 (with a spacer 349 from the base structure 312). The arm 336 rotates through a pivot plate 337 and a pivot block 360. Between the plate 337 and block 360 are a turnbuckle adjuster 363 and a Belleville spring 361 to absorb pressure as the pivot is undertaken and during operation of the apparatus 210*b*. The middle station 210*b* further includes a housing 313 covering the gears for controlling the roller mechanics (roller) 334, and also includes an extended coupler 385 leading to a gear tube 315. The gear tube 315 includes a main shaft (1012 of FIG. 30) within which a worm gear (1014 of FIG. 30) is present to drive the roller mechanics 334 and swing arm 323. The external coupler 385 is provided for insertion and connection with another station (such as the end wheel bearing station 210*c* of FIGS. 10 and 11) for connection of a separated gear tube and worm gear for ultimate relation with the drive module 315 that connects with the external adapter of 210*a* (228 of FIG. 6). The pivot plate 337 and block 360 thus allows for movement and manipulation of the roller (387 of FIG. 23, for example) as desired, from full interface to none, on demand. The middle station 210*b* further includes three shaft connectors 364 that function, in addition to the external adapter 385 to attach the station 210*b* with another with the simultaneous controlling of roller mechanics for all stations as connected in such a manner (such as the wheel bearing end station 21*c* of FIGS. 10 and 11), thus allowing, as above, for the modular capability herein described.

Figure 10:
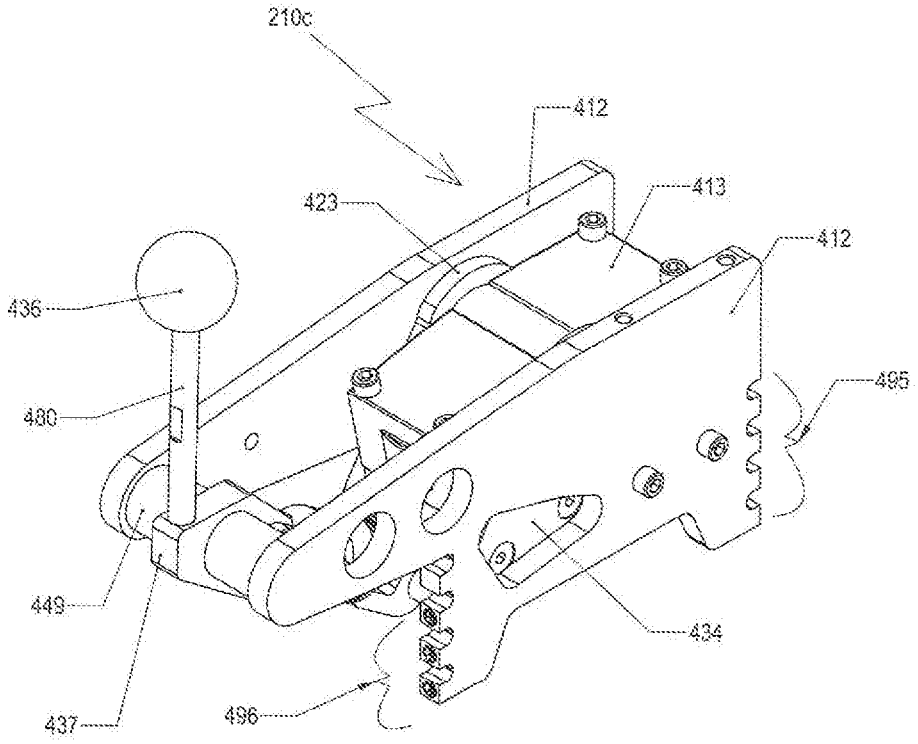
FIG. 10 is a side perspective view of one embodiment of an end (or wheel bearing) station of a modular roof panel seaming apparatus.
Figure 11:
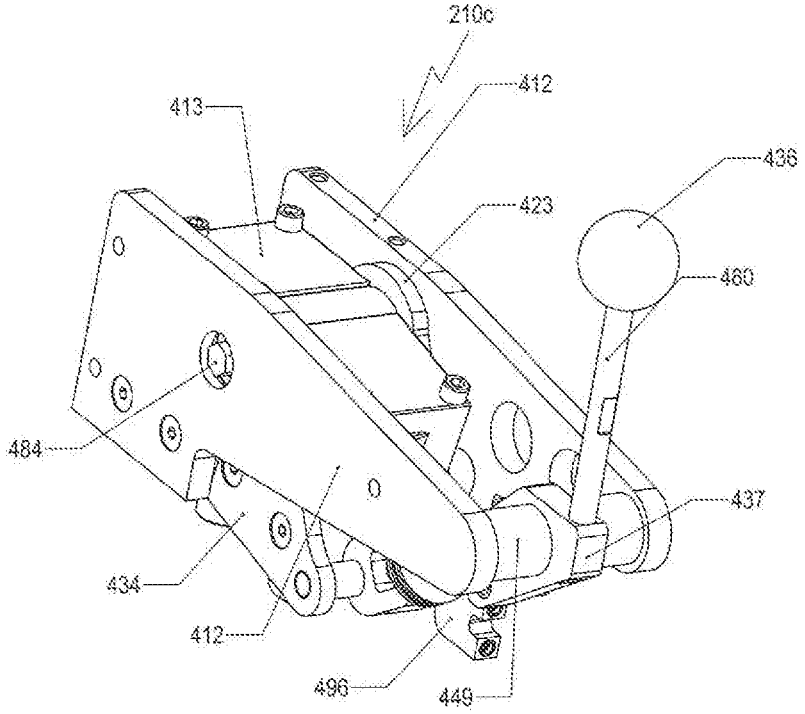
FIG. 11 is an opposing side perspective view of the wheel bearing station modular unit of FIG. 10.

FIGS. 10 and 11 are directed to a final station 210*c* with the same basic structures as above, a base component 412, rotating transport wheels (450 of FIG. 23, for instance), a housing 413 over a crimping roller mechanism 434, a lowering/raising arm 480 (with a spacer 449 from the base 412) and ball handle 436 to control operability of the crimping mechanism 234 through a pivoting structure 470. The arm 436 rotates through a pivot plate 437 and a pivot block 460. Between the plate 437 and block 460 are a turnbuckle adjuster 463 and a Belleville spring 461 to absorb pressure as the pivot is undertaken and during operation of the apparatus 210*a*. The front (wheel bearing) station 210*a* further includes a housing 413 covering the gears for controlling the roller mechanics (roller) 434, and also includes a recess 484 for connection with a coupler (385 of FIG. 10, for instance) leading to a gear tube 415. The gear tube 415 includes a main shaft (1012 of FIG. 30) within which a worm gear (1014 of FIG. 30) is present to drive the roller mechanics 434 and swing arm 423. The wheel bearing end station 210*c* further includes wheel adjustment blocks 495, 496 for wheel connections at differing heights on demand. Any other wheel bearing stations will include such blocks 495, 496 for such height adjustment purposes for greater versatility.

Figure 12:
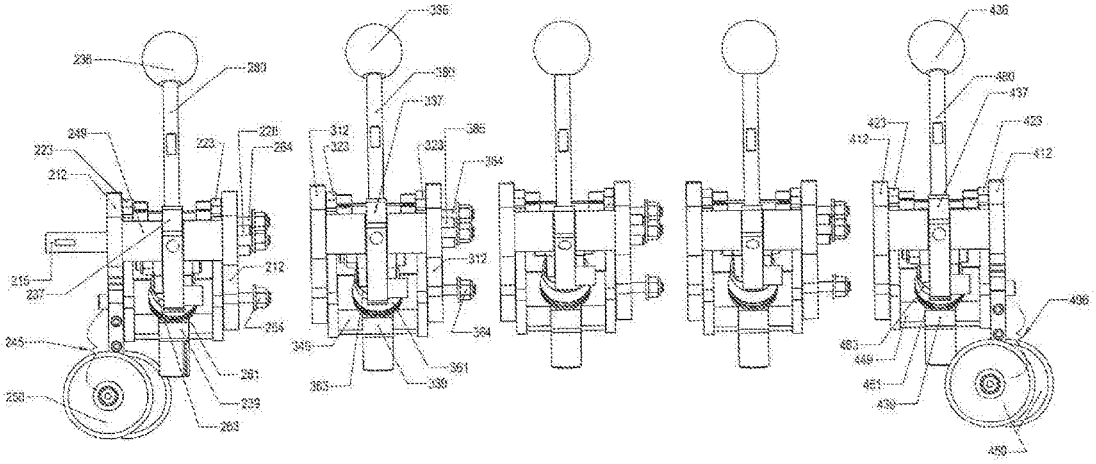
FIG. 12 is a front end view of separated modular front (wheel bearing), middle, and end (wheel bearing) station modular units as in FIGS. 6, 8, and 10.
Figure 13:
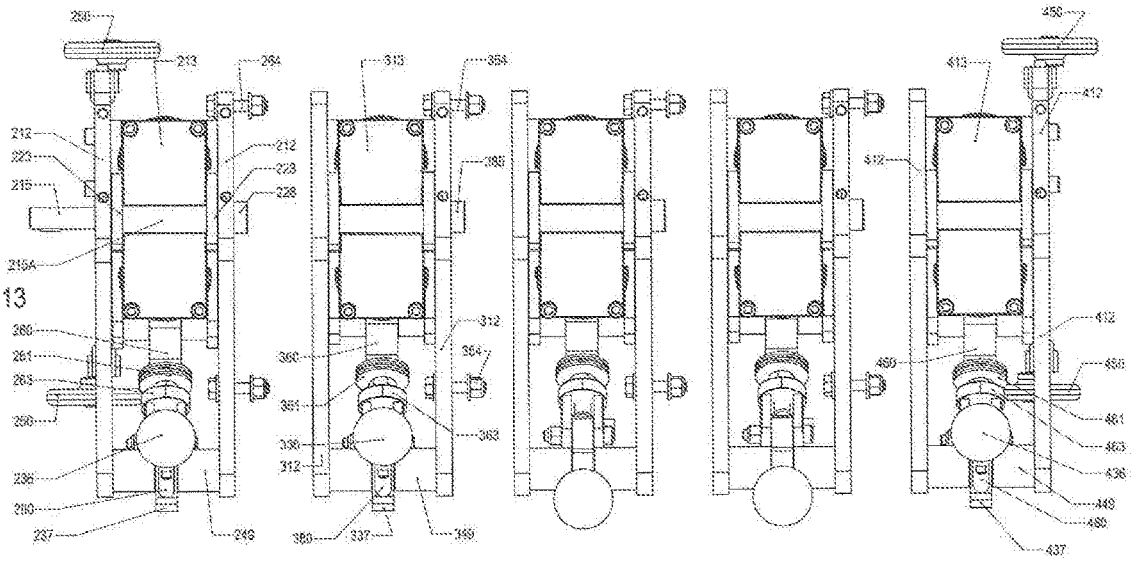
FIG. 13 is a top view of separated modular front, middle, and final station modular units as in FIG. 12.
Figure 14:
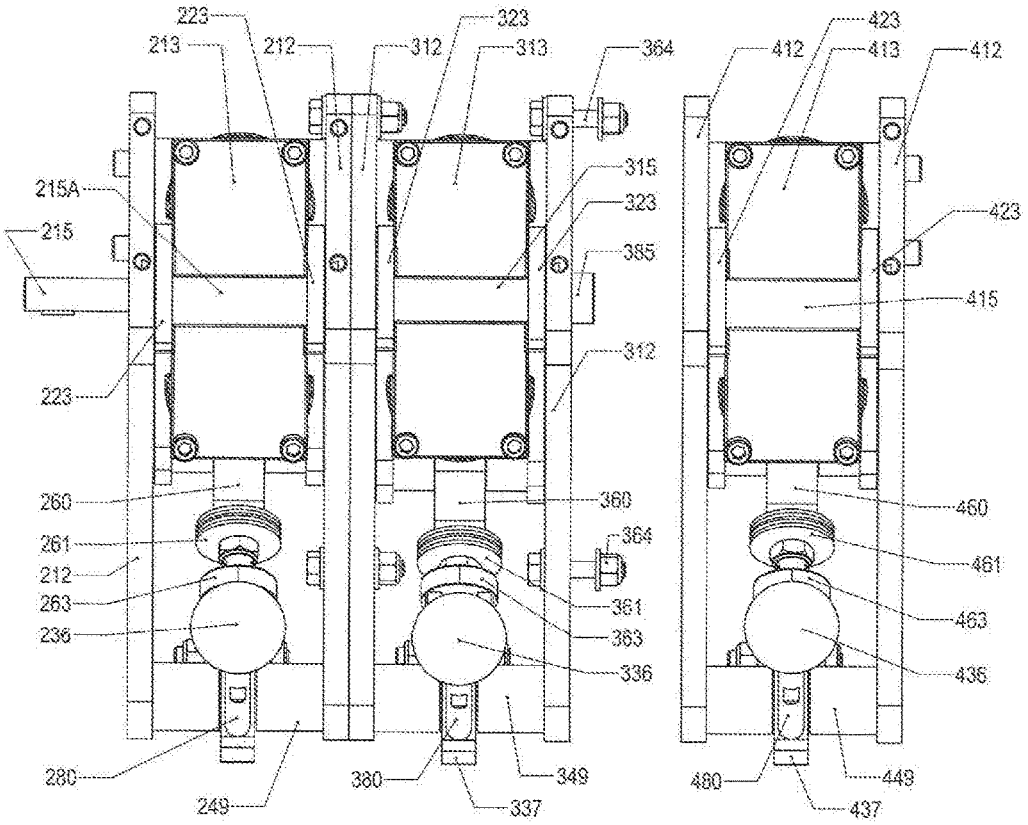
FIG. 14 is a top view of connected front and middle station modular units to form a modular roof panel seaming apparatus.
Figure 15:
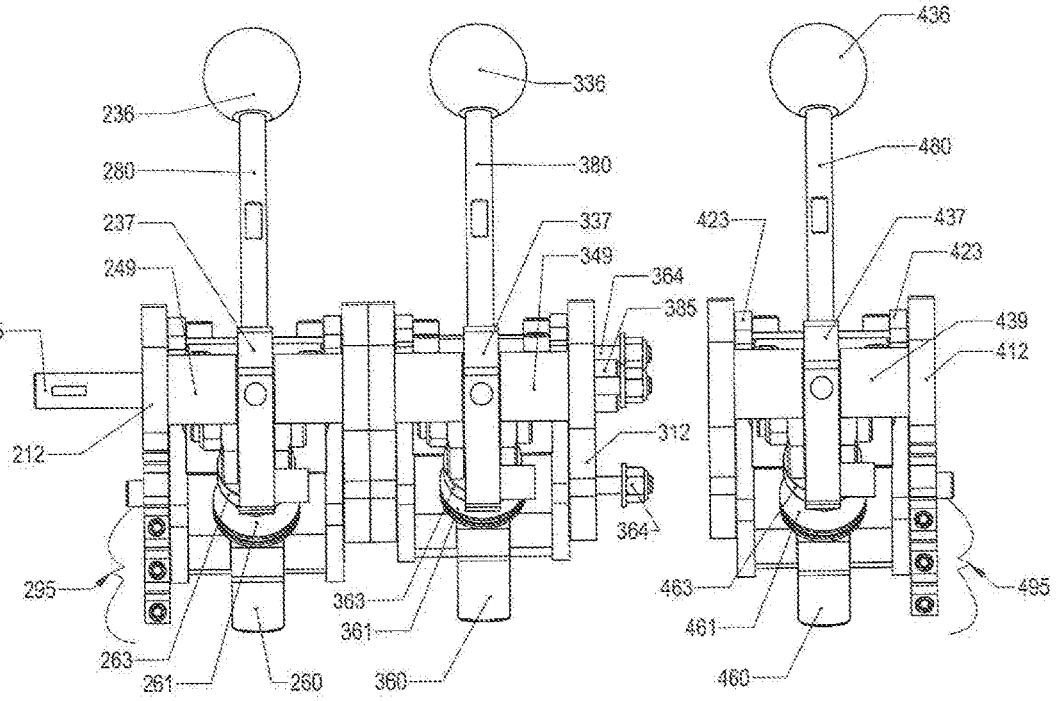
FIG. 15 is a front end view of the connected front and middle station modular units as in FIG. 14 with a further separated modular unit for expansion.
Figure 16:
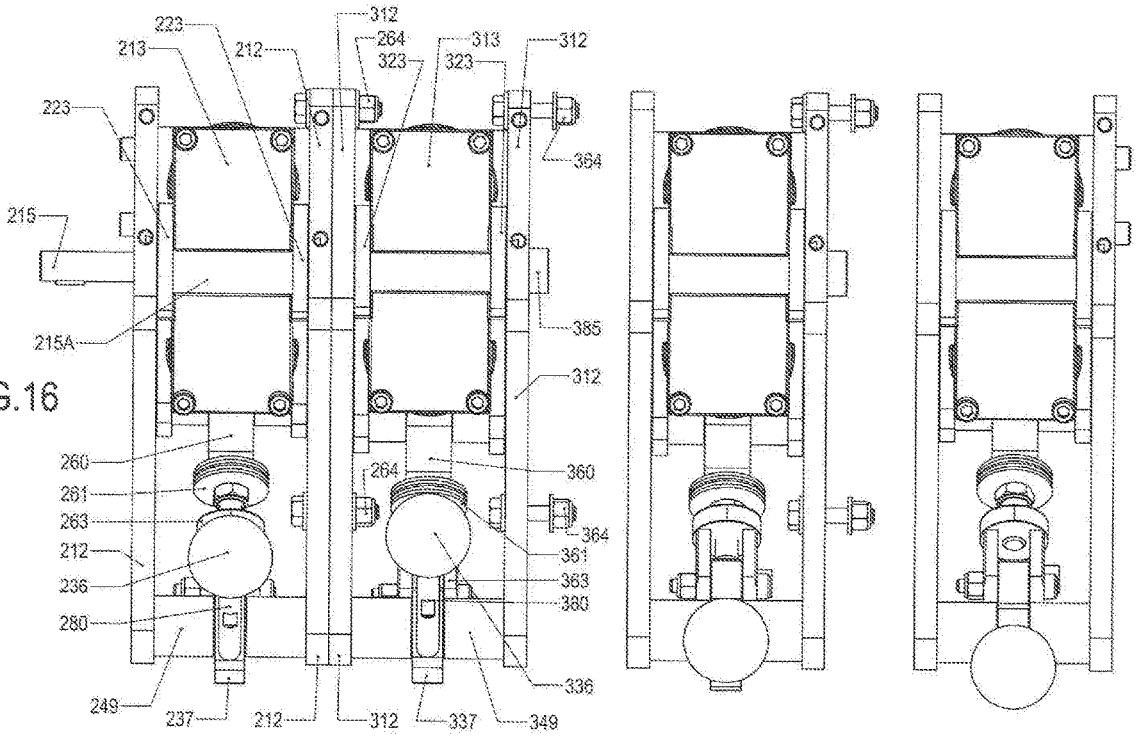
FIG. 16 is a top view of connected front, middle, and front station modular units to form a modular roof panel seaming apparatus.
Figure 17:
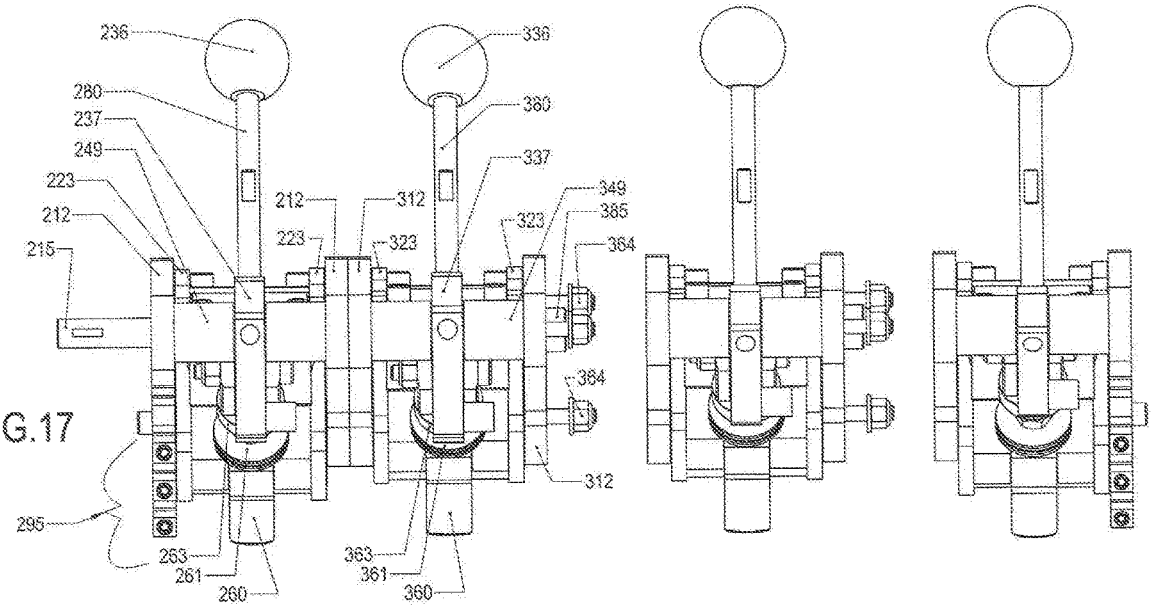
FIG. 17 is a front end view of the connected front and middle station modular units as in FIG. 16 with a further separated modular unit for expansion.

FIGS. 12 and 13 show exploded views of, for instance, a five-station apparatus with a front end wheel bearing station 210*a*, a middle station 210*b* (with two others of the same structure), and an end wheel bearing station 210*c*, with such stations as shown in FIGS. 6-11, above. This shows side-by-side alignment prior to connection to one another. FIGS. 14 and 15 show the connection of the front station 210*a* to the middle station 210*b* with the end wheel bearing station yet to be connected to the three-component apparatus. FIGS. 16 and 17 shows a four-component apparatus with the second middle station and the end wheel bearing station not connected. the connection of the end (final) station 210*c* to the middle station 210*b* for an entire modular device 700.

Figure 18:
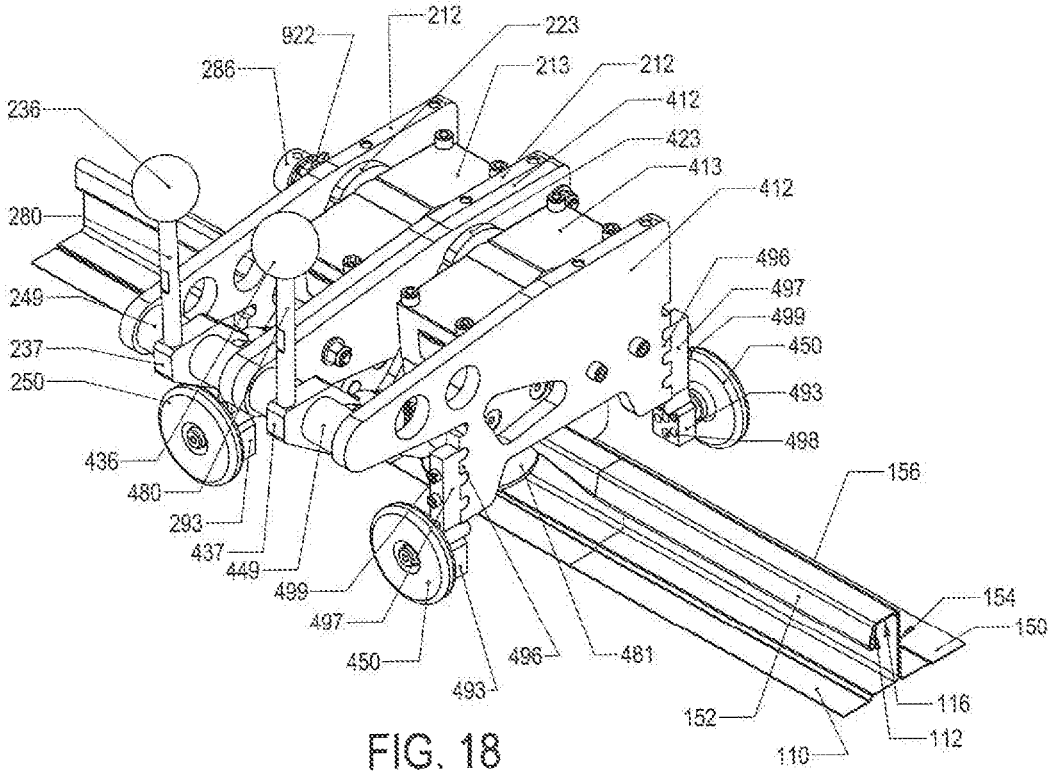
FIG. 18 is a side perspective view of one embodiment of two wheel bearing units combined as a single modular roof panel seaming apparatus placed over overlapping male and female ends of adjacent roof panels prior to seaming.
Figure 22:
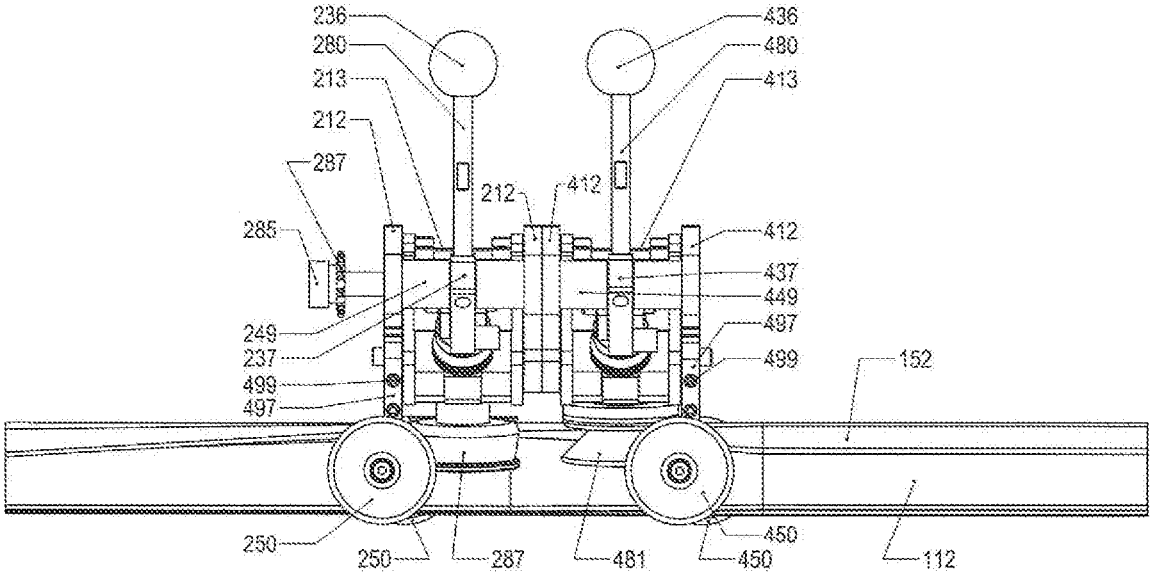
FIG. 22 is a side view of the apparatus of FIG. 18 present over overlapping roof panel ends.

FIGS. 18 and 22 show a two-station structure of a front wheel bearing station connected with an end wheel bearing station and placed over a to-be-modified roof panel seam 156 with a first panel 150 having a standing seam 154 and extension 152, and a second panel 110 with an internal seam component 116 and extension 112. The wheels 250, 450 are attached to wheel blocks 293, 493 that include different bolt locations 498 to allow for further wheel height adjustment other than the wheel adjustment blocks 495, 496. The wheel blocks 293, 493, thus include extensions that align with the wheel block adjustment blocks 495, 496 to allow for connection with bolts 499 at selected indentations therein for height differentials on demand. A sprocket 287 is present for association with an engine and drive chain (900 and 922, respectively of FIG. 25, for example) to operate the seaming actions thereof through operation and manipulation of the rollers 287, 481 on demand. Again, as noted above, the pivot arms 280, 380 may also adjust the actions of the rollers 287, 481 on demand, thus providing, in this instance, a two-roller apparatus for selected seaming operations.

Figure 19:
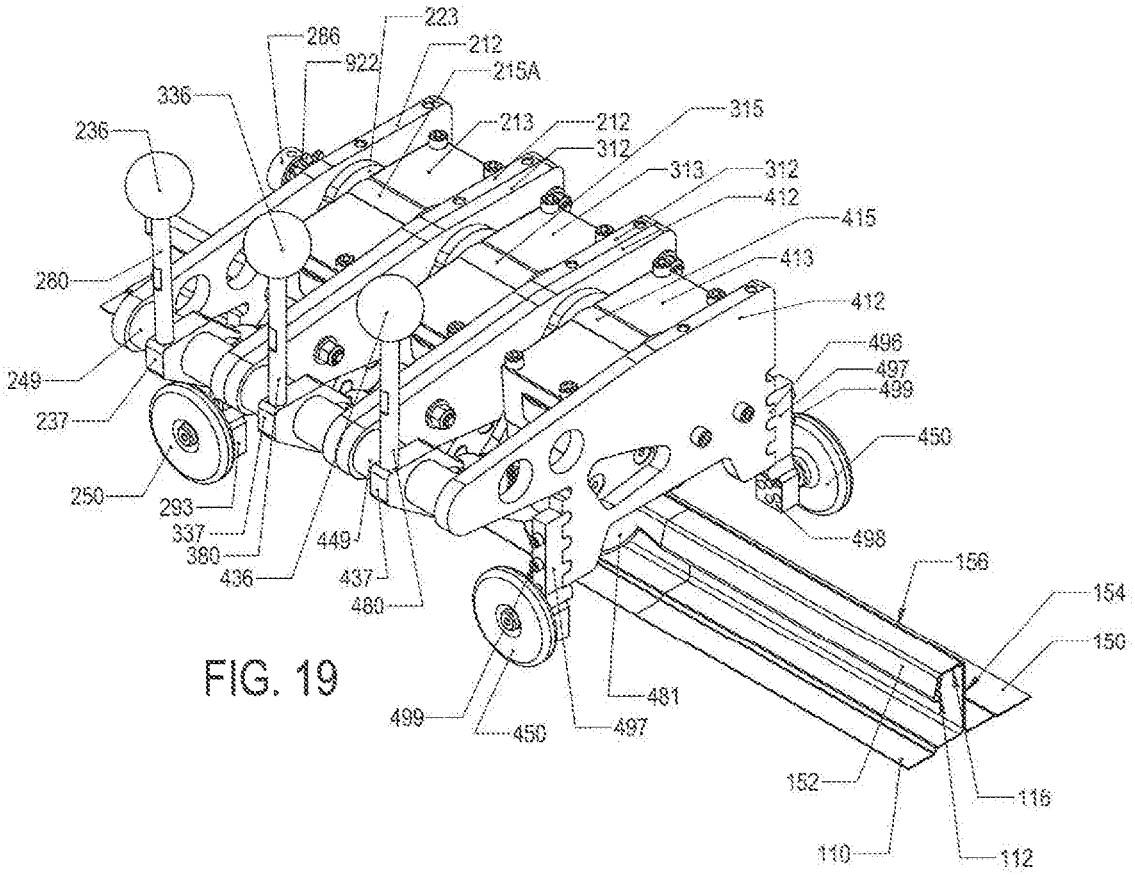
FIG. 19 is a side perspective view of one embodiment of two wheel bearing modular units separated and combined with a middle modular unit as a singular modular roof panel seaming apparatus placed over overlapping male and female ends of adjacent roof panels prior to seaming.
Figure 20:
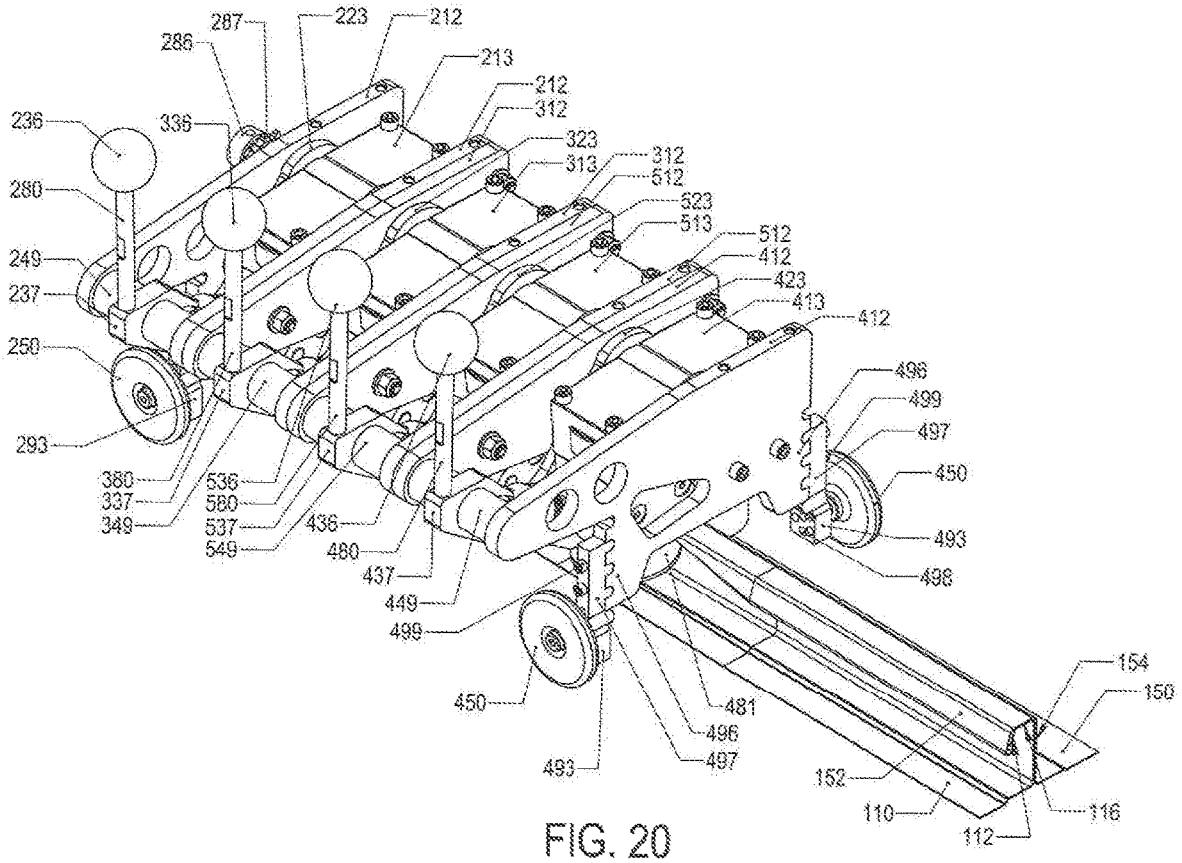
FIG. 20 is a side perspective view of one embodiment of two wheel bearing modular units separated and combined with two middle modular units as a single modular roof panel seaming apparatus placed over overlapping male and female ends of adjacent roof panels prior to seaming.
Figure 23:
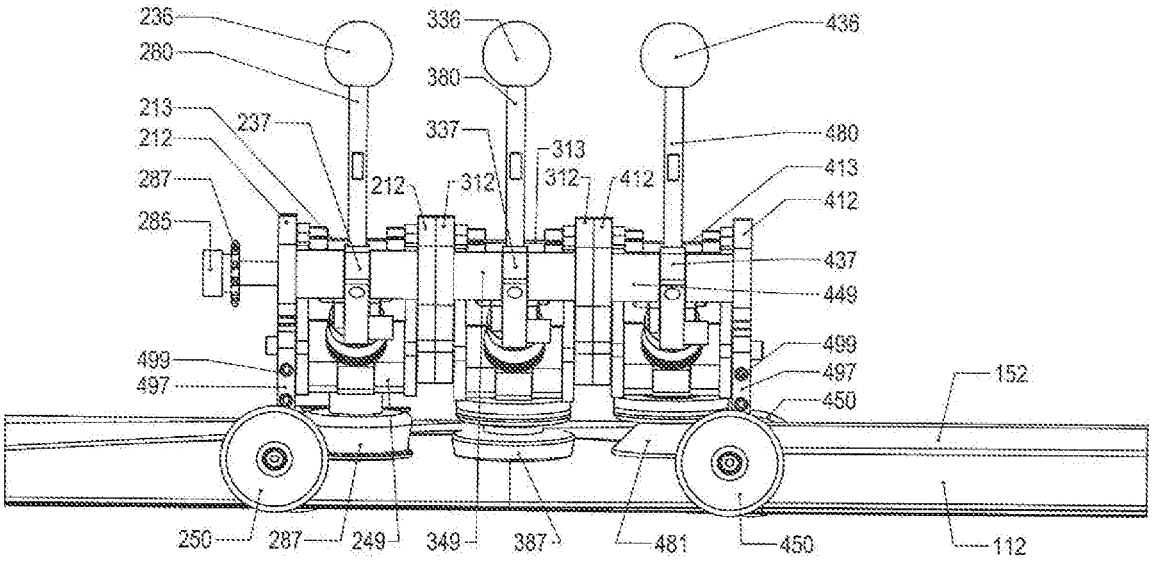
FIG. 23 is a side view of the apparatus of FIG. 19 present over overlapping roof panel ends.
Figure 24:
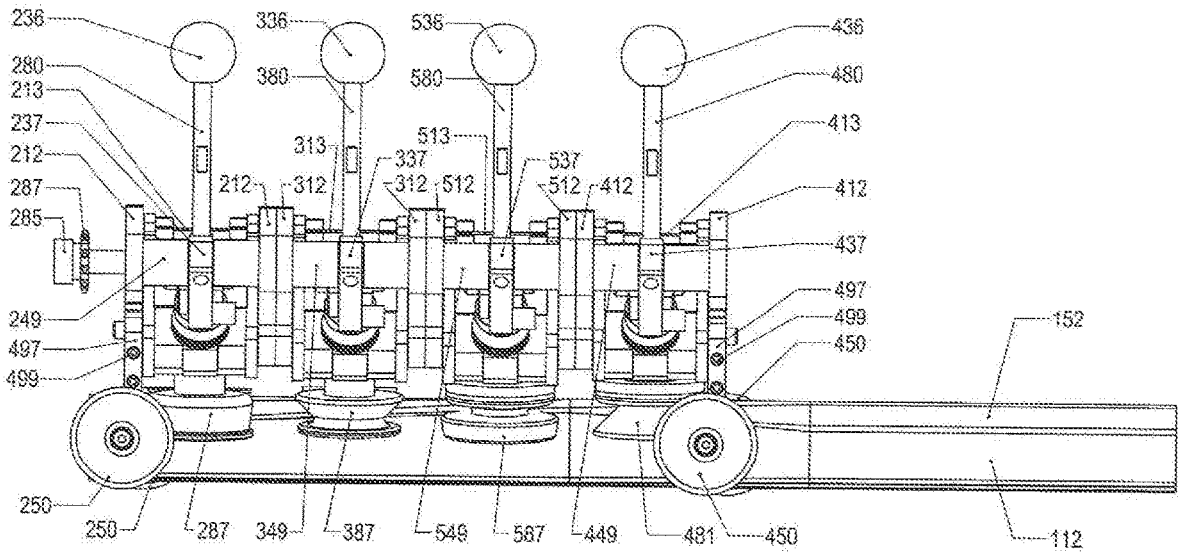
FIG. 24 is a side view of the apparatus of FIG. 20 present over overlapping roof panel ends.

FIGS. 19 and 23 shows the three-station apparatus with the middle station combined and the front and end wheel bearing stations, as well, over a standing seam 152. FIGS. 20 and 24 shows a four-station apparatus with a second middle station included and placed over a standing seam.

Figure 21:
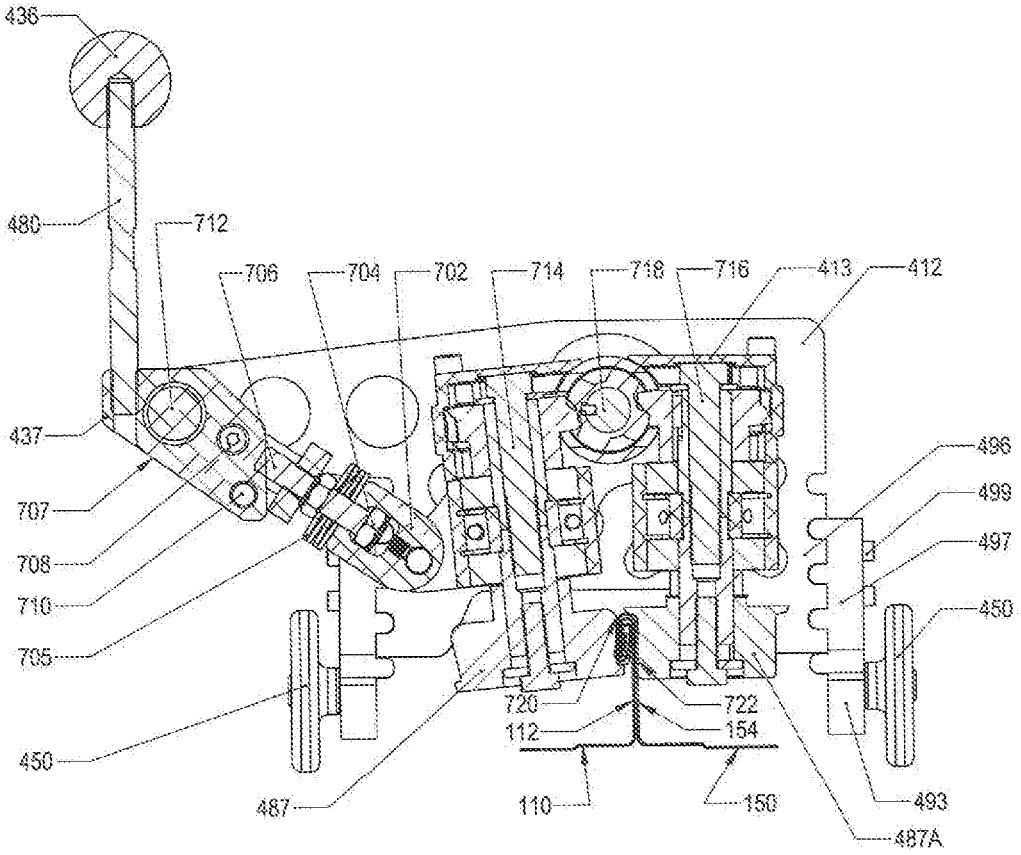
FIG. 21 is a front head-on view of the apparatus of FIG. 20 present over overlapping roof panel ends.

FIG. 21 then shows a head-on view of a modular device placed over and having created a formed seam 729 with a vertical riser 722 and two different ends 112, 154 of seamed panels 110, 150. From this perspective, the rollers 487, 487A straddle the seam 720 with the first roller 487 adjustable through the pivot arm 480 connected to the pivot plate 437. Further shown is a pivot shaft 712 within the lower pivot plate 707 and a pivot stop 710 to provide a limit to such movement. A should bolt 708 allows for adjustment of the turnbuckle (463 of FIG. 12) and the Belleville spring (here 705, but also 461 of FIG. 12) allows for controlled manipulation on demand. A threaded rod 706 leads from the picot plate 707 to the pivot block 702 with a pivot block nut 704 in place to retain such rod in place for such control. Further present is a shaft 714 (axle) bolted to allow for the roller 487 to be adjusted through the pivot arm 380 in this manner. The rollers 487, 487A are controlled through the wormgear 718 interface with separate shafts 714, 716 to supply the rotational energy that transfers thereto to rotate the rollers 487, 487A as needed for pressure application to the seam 720. The roller mechanism is thus covered with the housing 413 and attached to the base structure 412. The wheels 450 are provided are shown and described above with the ability to adjust the height of the wheels as needed through the wheel adjustment block 496, and wheel block 497 on demand with bolts 499 on the wheel base 493.

Figure 25:
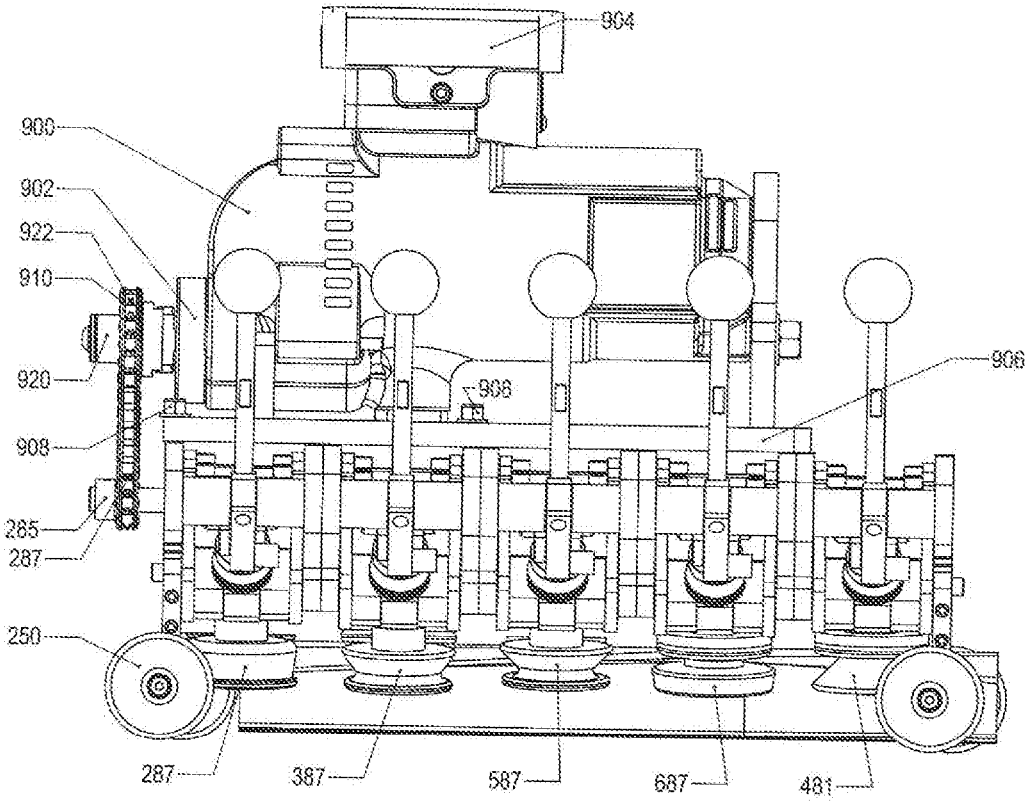
FIG. 25 is a side view of two wheel bearing modular units with three middle modular units and an engine with a connecting chain attachment for operation thereof as a single modular roof panel seaming apparatus.
Figure 27:
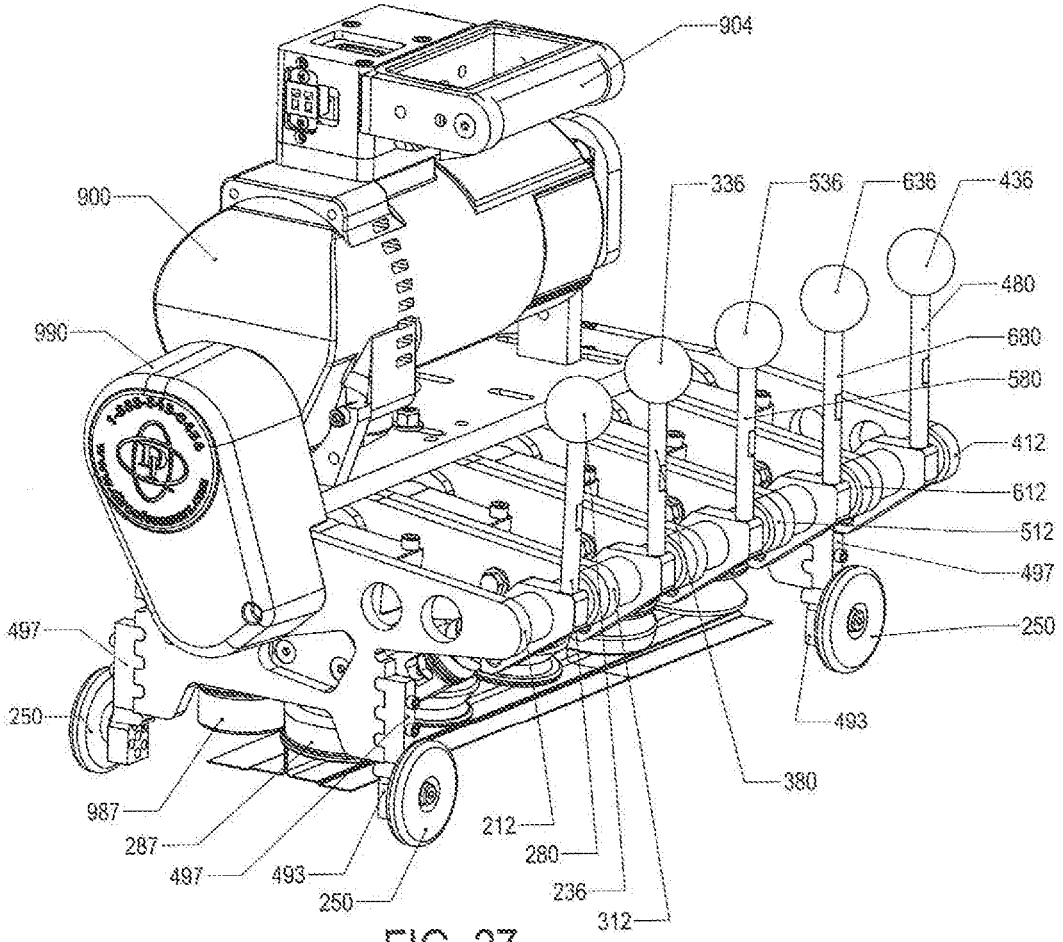
FIG. 27 is a side perspective view of the apparatus of FIG. 25 with a chain attachment cover.
Figure 29:
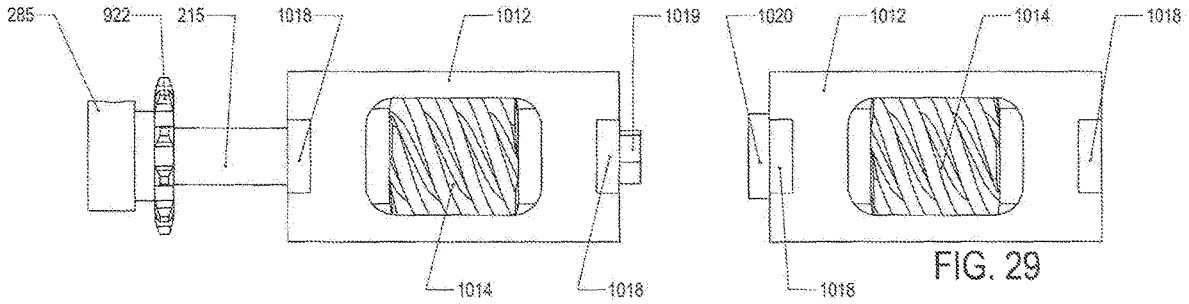
FIG. 29 is a side view of FIG. 28A.
Figure 29A:
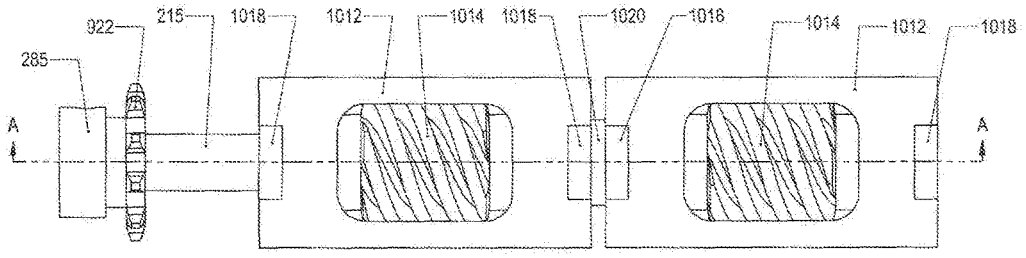
FIG. 29A is a side view of FIG. 28.
Figure 29B:
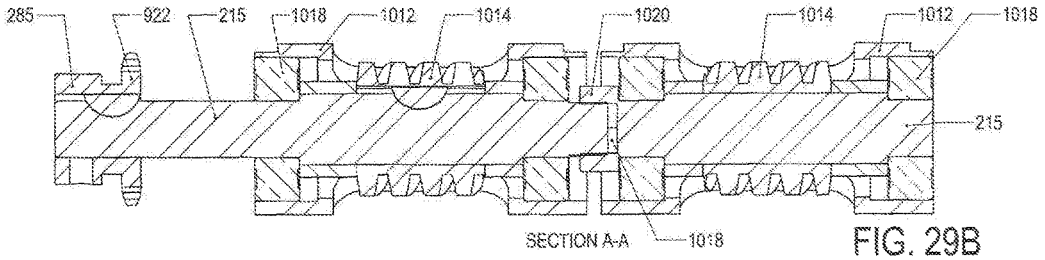
FIG. 29B is a cross-sectional view of FIG. 29A along line A-A.

FIG. 25 shows a five-station apparatus with an engine 900 connected thereto with a chain 922 applied over the apparatus sprocket 287 and a rotating extension 920 of the engine 900. A protector plate 902 covers the rotating gear (not illustrated) and a handle 904 allow for lifting of the engine 900 alone (and away from the apparatus, if desired) or for entire engine/apparatus removal and/or placement in relation to a standing seam. Multiple rollers 287, 387, 481, 587, 687 are supplied for pressure applications (and may be of any type and make). A manifold 906 provide a base for the engine to attach to the apparatus through bolts 908, as well. FIG. 27 thus shows a side perspective view of a potentially preferred modular apparatus with five stations selected and primed for manipulation and movement of rollers on demand at any suitable and permitted angle through pivot arm activity. The engine 900 includes a chain drive cover 990 to protect the user from chain operation, as well. Additionally, as noted and described above, in addition to the modular selections of stations, and the ability to move individual pivot arms, the height of the rollers (and the apparatus itself) in relation to the standing seam is adjustable through the wheel adjustable blocks and wheel mounts as well as wheel mounting holes for axle insertion, as well. This multi-versatile modular apparatus is hereby unknown and unused within the roof seaming industry.

Figure 26:
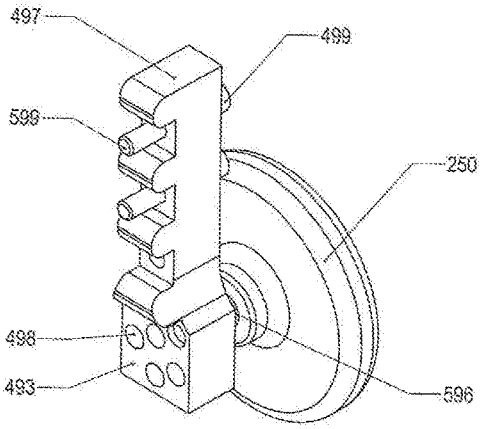
FIG. 26 is a side perspective view of a wheel mount block.
Figure 26A:
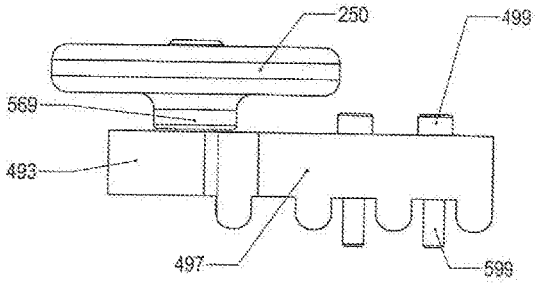
FIG. 26A is a side view of the block of FIG. 26.

FIGS. 26 and 26A show side views of the wheel block 493 and wheel mounting holes 498, wheel block extensions 497 and securing bolts 599 for the wheel 250 to be adjusted in terms of height in multiple manners. The mounting holes 498 are shown with five different heights all presented with even distances for the user to easily adjust the entirety of wheel heights with all wheel mounts in such a fashion. The wheel 250 has an axle 569 that simply may be introduced within any of the five mounting holes 498 on demand. Likewise, then, the extensions 497 of the block 493 includes bolt 499, 599 that all align with the indentations of the wheel adjustment block (496 of FIG. 20, for example) with the ability to insert an extension within any of the indentations thereof to adjust for height (with the bolts in place as needed). A uniform height can then be provided with the same extension/indentation pairing and mounting holes selection for all of the wheels of the apparatus.

FIGS. 29, 29A, 29B, 30, and 30A all show the gear tubes 1012 with a front station drive module 215 and a sprocket 922 with a coupler 1020 and gear tube connector 1019 and recess 1018 for coupler placement. The wormgear 1014 is present through a window to interface with the main shaft (714, 716 of FIG. 21) of the roller mechanism. As noted above, the coupler 1020 may be sized differently (as in FIG. 30, for instance) to allow for different lengths of the apparatus overall and distances between stations, if desired. Three cross-sections along A-A in FIGS. 29B and 30A thus show the accessibility of the wormgears 1014 within the confines of the gear tubes 1012 to connect across the stations to permit such simultaneously power drive through all of the rollers and mechanisms thereof for modular capability to function properly and, again, on demand.

Thus, with the modular structural device, whether with a single final station (with motor), a combination of two stations (one being the final with the motor to control the seaming capacity and operation), or three (or more) stations, again with the motor controlling from the final station to all connecting modular components for seaming operations, there is provided far greater versatility and reliability (to protect the roof panel materials, for example, or to accord far stronger torque applications for more robust and effective seaming results with higher gauge materials as the roof panel components.

It will be understood that various changes in the details, materials, and arrangements of the parts which have been described and illustrated herein in order to explain the nature of this invention may be made by those skilled in the art without departing from the principles and scope of the invention as expressed in the following claims.

What I claim is:

1. A modular roof panel seaming apparatus including a plurality of from two to five individual, connectable, stations, with each said station comprising at least one pressure application roller attached in rotatable relation to a base aligned for engagement with female and male roof panel portions of separate but adjacent panels at the same time and said at least one pressure application roller, wherein said female and male roof panel portions have overlapping edges when placed one over the other in parallel fashion, wherein said at least one pressure application roller creates a seam between said female and male roof panel portions when activated along the length of said roof panel portions; wherein said at least one pressure application roller is interchangeable between different sizes, shapes, and pressure application levels; wherein said stations are removable and replaceable by other stations on demand; wherein each of said plurality of individual, connectable stations is operated by a single motor when said individual, connectable stations are connected together in any number from two to five; wherein said plurality of stations comprises gear tubes aligned for placement of separate wormgears therein that are connectable between said stations for simultaneous operation by said single motor across all said stations upon connection thereof; and wherein said plurality of stations are connectable through couplers present between each said station external to said gear tubes.

2. The modular roof panel seaming apparatus of claim 1 wherein at least two of said plurality of stations are wheel bearing stations with adjustable wheel blocks and mounting holes present thereon to allow for roof panel seaming apparatus height adjustments on demand.

* * * * *